US005609273A

United States Patent [19]

Firestone et al.

[11] Patent Number: 5,609,273

[45] Date of Patent: Mar. 11, 1997

[54] BARRIER PACKAGING AND MATERIALS THEREFOR

[75] Inventors: Bruce A. Firestone, Irvine; Matthew A. Dickason, Tustin, both of Calif.

[73] Assignee: Allergan, Inc., Irvine, Calif.

[21] Appl. No.: 398,557

[22] Filed: Mar. 3, 1995

[51] Int. Cl.[6] ..... B65D 47/18

[52] U.S. Cl. ..... 222/215; 222/420; 428/35.7; 428/36.9; 428/36.92

[58] Field of Search ..... 222/420, 215; 428/35.7, 36.9, 36.92

[56] References Cited

U.S. PATENT DOCUMENTS

| | | | |
|---|---|---|---|
| 3,857,754 | 12/1974 | Hirata et al. | 428/35.7 |
| 4,563,104 | 1/1986 | Saint-Amand | 222/420 X |
| 4,645,695 | 2/1987 | Negi et al. | 428/35.7 |
| 5,013,459 | 5/1991 | Gettings et al. | 210/764 |
| 5,056,689 | 10/1991 | Heyl et al. | 222/420 X |
| 5,071,686 | 12/1991 | Genske et al. | 428/35.7 |
| 5,105,993 | 4/1992 | LaHaye et al. | 222/189 |
| 5,356,052 | 10/1994 | Poynter | 222/420 |
| 5,464,122 | 11/1995 | Lifshey | 222/420 X |
| 5,516,564 | 5/1996 | Root et al. | 222/420 X |

*Primary Examiner*—Kevin P. Shaver
*Attorney, Agent, or Firm*—Walter A. Hackler

[57] ABSTRACT

A packaged pharmaceutical product having extended shelf life includes a pharmaceutical preparation comprising chlorobutanol and a dispensing container. The container has a hollow body, having an open end therein and is formed from a blend of low density polyethylene, having high chlorobutanol permeability, and a polypropylene, having low chlorobutanol permeability. A body wall thickness, enables both drop-by-drop dispensing of the pharmaceutical preparation by manual squeezing of the body, and, in combination with the blend of polymers, preventing significant loss of chlorobutanol through the body wall upon storage of the container with the body filled with the pharmaceutical preparation. A dropper tip fixed to the body open end is provided for forming droplets of pharmaceutical preparation upon manual squeezing of the body.

22 Claims, 4 Drawing Sheets

BARRIER PACKAGING AND MATERIALS THEREFOR

The present invention is generally directed to packaging and, more specifically, directed to a packaged pharmaceutical product and a method of packaging.

Many pharmaceutical preparations, including those for ophthalmic use, utilize chlorobutanol, which is a widely used anti-microbial preservative which is added to numerous pharmaceutical preparations, as well as being an active ingredient in certain oral sedatives and topical anesthetics.

When used as a preservative, the concentration of chlorobutanol in the pharmaceutical preparation, is preferably above about 0.3% W/V of the pharmaceutical preparation. Such concentrations enable storage of the pharmaceutical preparation for periods of time of up to 18 or 24 months or more. Certain pharmaceutical preparations, such as ophthalmic preparations are limited in the amount acceptable of chlorobutanol therein to no more than about 0.5% W/V in view of the cytotoxicity of this agent.

While squeezable containers are presently used for storage of pharmaceutical preparations comprising chlorobutanol, such storage systems, in view of the permeability of chlorobutanol through commonly used low density polyethylene containers, have now been found to be inadequate because of loss of chlorobutanol through the polyethylene.

With particular reference to pharmaceutical preparations which need to be dispensed on a drop-by-drop basis, the most suitable packaging is a squeezable container. Heretofore, rigid containers, such as glass and non-permeable plastics, have been utilized in conjunction with an eye dropper type dispense, however, this arrangement leads to non-sterile conditions due to exposure of the preparation to the atmosphere. P A further complication with regard to the storage of pharmaceutical preparations utilizing chlorobutanol is the fact that the pH of the pharmaceutical preparation goes down, i.e., becomes more acid, upon storage in a container having an absolute barrier to chlorobutanol migration, such as glass. Accordingly, glass containers are thus unacceptable for long-term storage of some pharmaceutical products containing chlorobutanol due to the change of pH of the pharmaceutical preparation over a long shelf life. In addition, a glass container requires an additional eye dropper type dispenser for proper utilization by a patient using the pharmaceutical preparation.

It should be evident that the container for the pharmaceutical preparation is the most important part of the packaged pharmaceutical product in that it contacts the pharmaceutical preparation most extensively over a long period of time, particularly in the warehousing thereof prior to sale, and in the user's home prior to complete use of the pharmaceutical preparation which is dispensed on a drop-by-drop basis as needed.

Typical user friendly containers, or dispensers, or bottles, for pharmaceutical preparations, are formed from polyethylene, which, in most instances, provide a suitable combination with a pharmaceutical preparation which results in a packaged pharmaceutical production that is user friendly for dispensing of the pharmaceutical preparation on a drop-by-drop basis.

However, if the pharmaceutical preparation includes chlorobutanol as a preservative, a complex problem is introduced. Specifically, polyethylene is permeable by chlorobutanol and therefore, upon storage, chlorobutanol permeates the container wall and evaporates, reducing the concentration in the preparation. Accordingly, its preservative value to the pharmaceutical preparation is diminished.

This phenomenon occurs over a matter of days, depending on the storage temperature. As hereinabove noted, a generally accepted upper limit for the amount of chlorobutanol in an ophthalmic pharmaceutical preparation is about 0.5% W/V. It should also be appreciated that the lower specification for an acceptable amount of preservative, such as chlorobutanol may be 0.3% W/V (European requirement) or 0.2% W/V (U.S. requirement) if the chlorobutanol content in a pharmaceutical preparation is reduced by about 40%, due to loss through a container wall, the pharmaceutical preparation no longer meets preservative specifications. As hereinabove mentioned, this can occur in a matter of days if the container is formed from 100% polyethylene.

Other materials suitable for containing a pharmaceutical preparation preserved with chlorobutanol include polypropylene, among other polymers; however, while these resins are suitable for preventing the migration of chlorobutanol therethrough, they, because of their modulus of elasticity, cannot be used in a user friendly, i.e., squeezable, container.

Therefore, there is need for a packaged pharmaceutical product and method which provides for a user friendly squeezable container for pharmaceutical preparations which include, as a preservative, chlorobutanol.

SUMMARY OF THE INVENTION

A packaged pharmaceutical product having extended shelf life in accordance with the present invention, generally includes a pharmaceutical preparation comprising chlorobutanol. More specifically, the pharmaceutical preparation may include chlorobutanol up to 0.5% W/V, to insure its preservative activity.

In addition, a dispensing container is provided which includes a hollow body, having an open end thereon, formed from a blend of low density polyethylene and polypropylene. The low density polyethylene, while suitable for forming a squeezable container, includes a high chlorobutanol permeability. This high chlorobutanol permeability is compared to the chlorobutanol permeability of polypropylene, which, in comparison, is very low. However, polypropylene is not suitable for forming a user friendly, or squeezable container.

In addition, a body wall thickness provides a means for both enabling drop-by-drop dispensing of the pharmaceutical preparation by manual squeezing of the body, but also, and in combination with the blend of polymers, preventing significant loss of chlorobutanol through the body wall upon storage of the container with the body filled with the pharmaceutical preparation. In this regard, significant loss of the chlorobutanol means an amount not affecting the preservative activity of the chlorobutanol, which has hereinabove been defined as not being below 0.2% W/V or 0.3% W/V of the pharmaceutical preparation.

Finally, dropper tip means are provided and fixed to the body open end for forming droplets of pharmaceutical preparation upon manual squeezing of the body.

More particularly, the dispensing container according to the present invention includes a blend of polymers comprising between about 50% by weight and about 75% polypropylene and between about 50% and 25% polyethylene by weight.

More specifically, it has been found that a blend of about 60% polypropylene and about 40% polyethylene provides for a squeezable container body, while at the same time, providing a satisfactory barrier for the passage of chlorobutanol therethrough so that long-term storage can be effected without the level of chlorobutanol falling below 0.3% W/V of the pharmaceutical preparation.

Still more particularly, it has been found that a polypropylene best suited for blending with polyethylene is one having a flexural modulus of about 120,000 PSI. Using this blend, it has been found that an effective wall thickness for providing both squeezability and a barrier to the passage of chlorobutanol is between about 0.018" (0.46 mm) and 0.032" (0.81 mm). As part of the packaged pharmaceutical product, both define the present invention as also directed to a dispensing container for dropwise dispensing of a pharmaceutical preparation which includes chlorobutanol as a preservative. The body is provided with an open end therein, with the body being formed from a blend of low density polyethylene, having high chlorobutanol permeability, and a polypropylene having low chlorobutanol permeability.

A body wall thickness is determined for both enabling drop-by-drop dispensing of the pharmaceutical preparation by manual squeezing of the body and, in combination with the blend of polymers, preventing significant loss of chlorobutanol through the body wall upon storage of the container with the body filled with the pharmaceutical preparation. In addition, a sealable dropper tip is provided which provides means for forming droplets of pharmaceutical preparation upon squeezing of the body.

The invention also encompasses a method of packaging a pharmaceutical preparation which includes forming a container from a resin blend of polypropylene and a low density polyethylene with a wall thickness enabling drop-by-drop dispensing of the pharmaceutical preparation by manual squeezing of the container. At the same time, storage of the pharmaceutical preparation for a period of at least 200 days at about 25° C., is enabled without loss of more than 40% of the original amount of chlorobutanol through the wall of a container. When an original amount of about 0.5% W/V chlorobutanol is present in the pharmaceutical preparation, extended shelf-life storage is enabled without the chlorobutanol content of the pharmaceutical preparation falling below about 0.3% W/V.

Further steps in accordance with the present invention include filling the container with the pharmaceutical preparation and providing a sealable dropper tip for enabling drop-by-drop dispensing of the pharmaceutical preparation from the container.

BRIEF DESCRIPTION OF THE DRAWINGS

The present invention may be more clearly appreciated when taken in conjunction with the accompanying drawings, in which.

DETAILED DESCRIPTION

Any suitable pharmaceutical preparation may be incorporated into the present invention and particularly ophthalmic preparations suitable for a dropwise dispensing in an eye. As a specific example of such a preparation as a wetting solution which may include polyvinyl alcohol with hydroxypypropyl methylcellulose, edetate disodium, sodium chloride, potassium chloride, with chlorobutanol being added as a preservative in an original amount of 0.5% W/V. This pharmaceutical preparation is presented here by example only, for the purpose of defining the present invention. The characteristics of the present invention, which includes a packaged pharmaceutical product, is shown in FIGS. 1–6, as hereinafter described.

Figure 7:
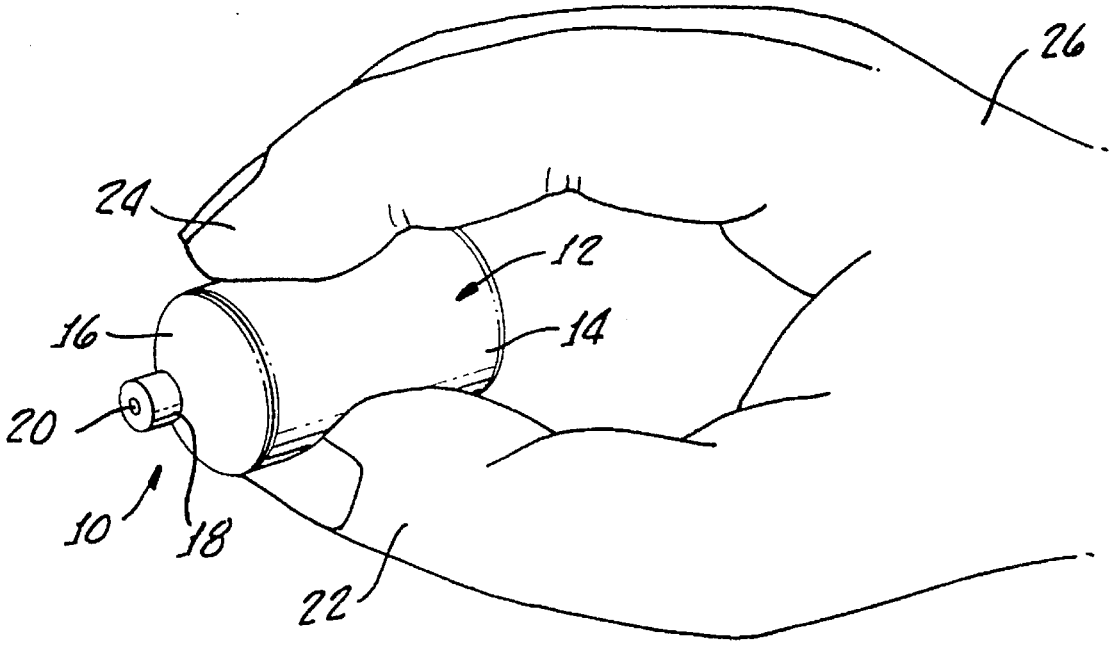
FIG. 7 is a view of a dispensing container in accordance with the present invention as it may be used.

With reference to FIG. 7, there is shown a packaged pharmaceutical product 10 which includes a dispensing container 12, having a hollow body 14, with an end 16 having an opening 18 thereon, to which is fixed a dropper tip 20 which provides means for forming droplets of pharmaceutical preparation upon manual squeezing of the body 14, for example, a thumb 22 and forefinger 24 of a hand 26.

As hereinabove noted, the present invention provides a packaged pharmaceutical product which has a longer shelf life than heretofore possible utilizing a pharmaceutical preparation having chlorobutanol therein and a squeezable container. As noted, the container 12 is the most important part of the packaging in that it contacts the pharmaceutical preparation, not shown, and thus must provide a barrier to the permeation of chlorobutanol therethrough.

The formation of the container 12, as also hereinabove noted, may be through blow molding, or the like, or in a conventional technique, however, the polymer from which the container is formed is of utmost importance.

Materials, such as polypropylene, which are known to provide barrier properties to the passage of chlorobutanol therethrough, are not suitable for a squeezable container, i.e., as shown in FIG. 7, because of the rigid like properties of polypropylene. On the other hand, as hereinabove noted, while polyethylene is a resin which can be formed into a container with squeezable properties, no barrier to the passage of chlorobutanol is provided.

Still more importantly, it has been found that polypropylene, having a selected modulus of elasticity, also affects the properties of the final blend utilized in the manufacture of the container 12.

Specific examples are a polypropylene having a flexural modulus according to ASTM test method D 790 of 145,000 PSI, such as manufactured by Rexene Resins, under the product type PP23M2 and a polypropylene having a flexural modulus of 120,000 PSI manufactured by Fina, under the Product No. 7231X, have differing barrier properties when blended with polyethylene.

Because of the difference of flexural modulus, the Rexene polymer is a stiffer and less squeezable resin than that of the Fina Resin.

Figure 1:
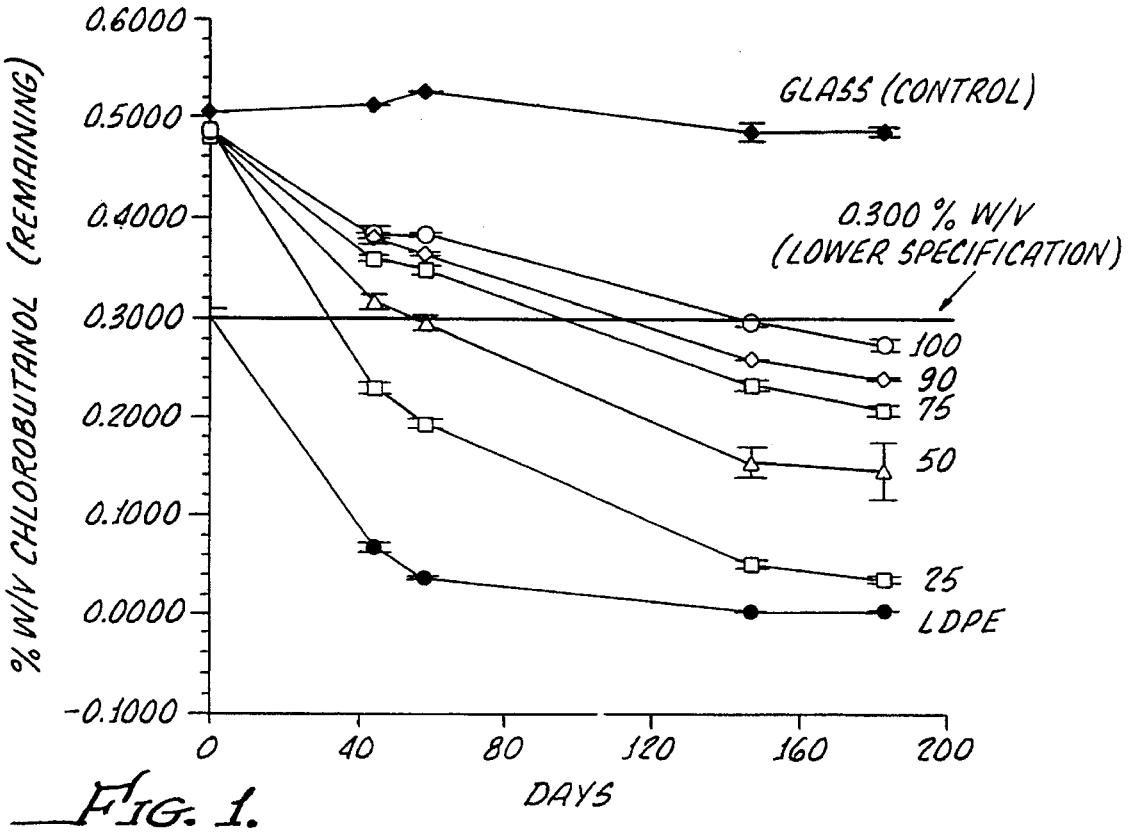
FIG. 1 is a plot of the amount of chlorobutanol remaining with time in a pharmaceutical preparation while stored at 45° C. in a 10 ml container as a function of a blend of polyethylene and a polypropylene having a flexural modulus of 120,000 PSI.
Figure 2:
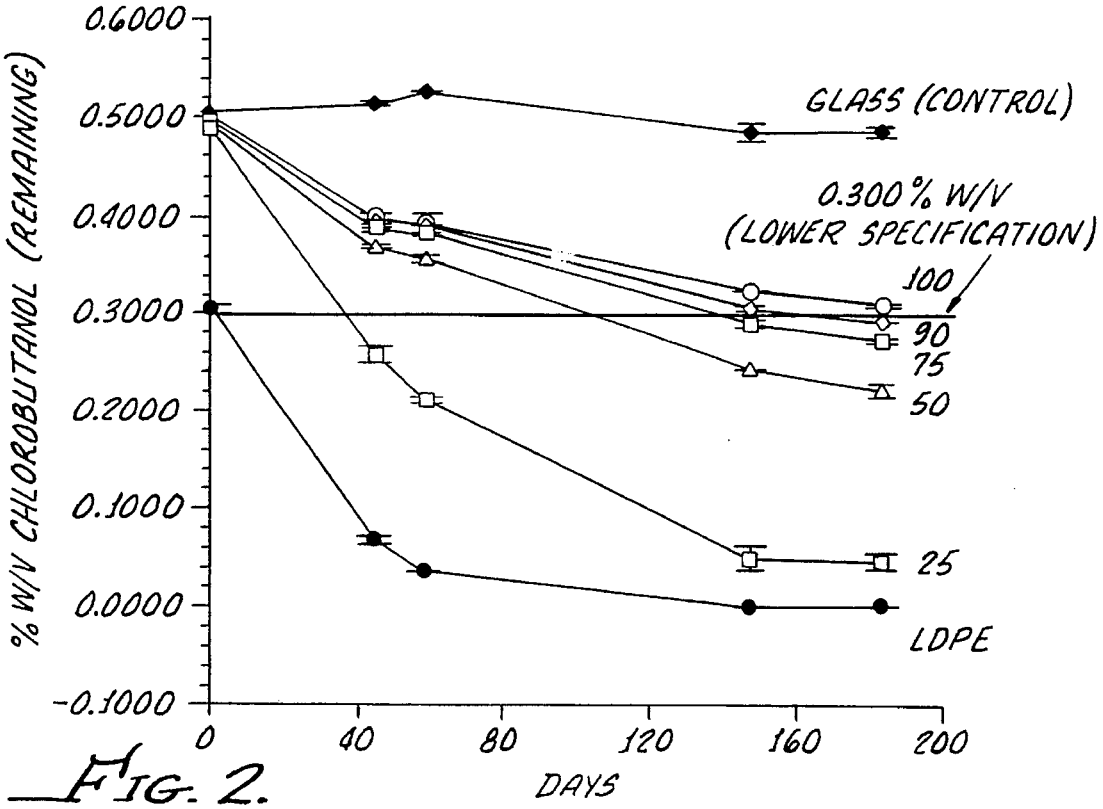
FIG. 2 is similar to the part shown in FIG. 1 with the blend of polymers being polyethylene and a polypropylene having a flexural modulus of 145,000 PSI.
Figure 3:
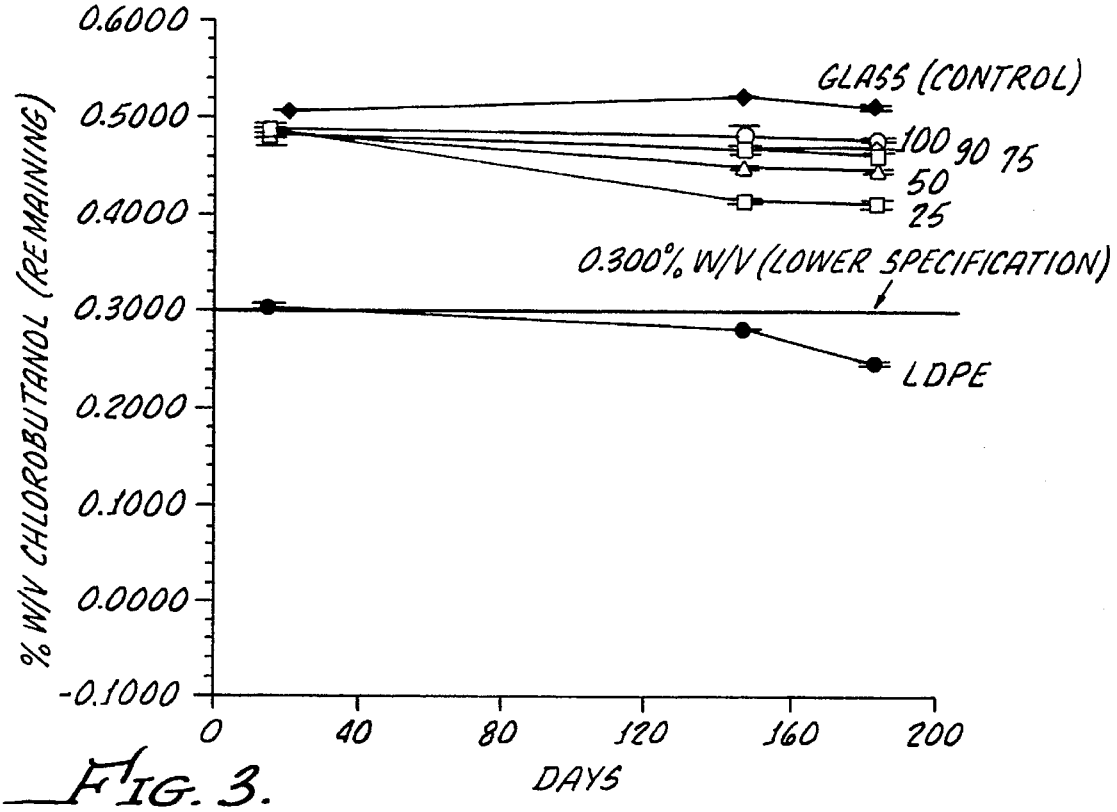
FIG. 3 corresponds to the blends of polymers shown in FIG. 1 when stored at 25° C.
Figure 4:
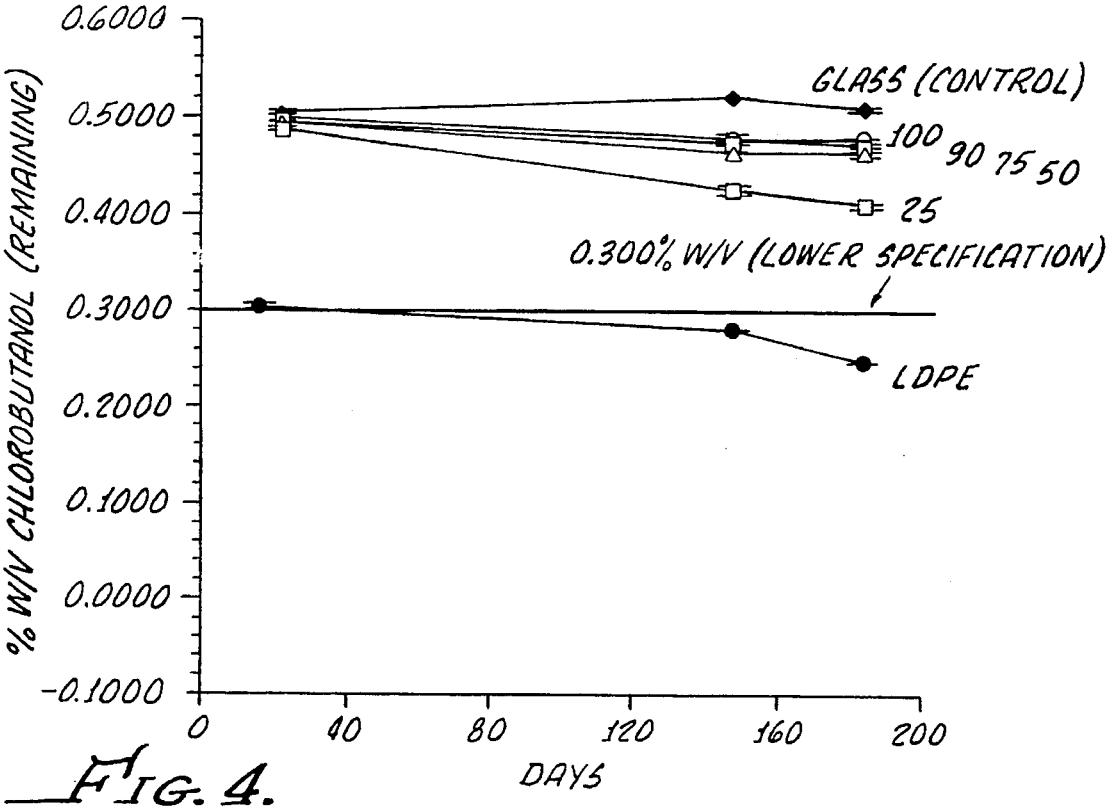
FIG. 4 corresponds to the blends of polymers shown in FIG. 2 stored at 25° C.

FIGS. 1 and 2 show the concentration of chlorobutanol for barrier bottles stored at 45° for a Fina blended polymer and a Rexene blended polymer, respectively. Similarly, FIGS. 3 and 4 show the same bottle configuration with the storage temperature being 25° C.

Figure 5:
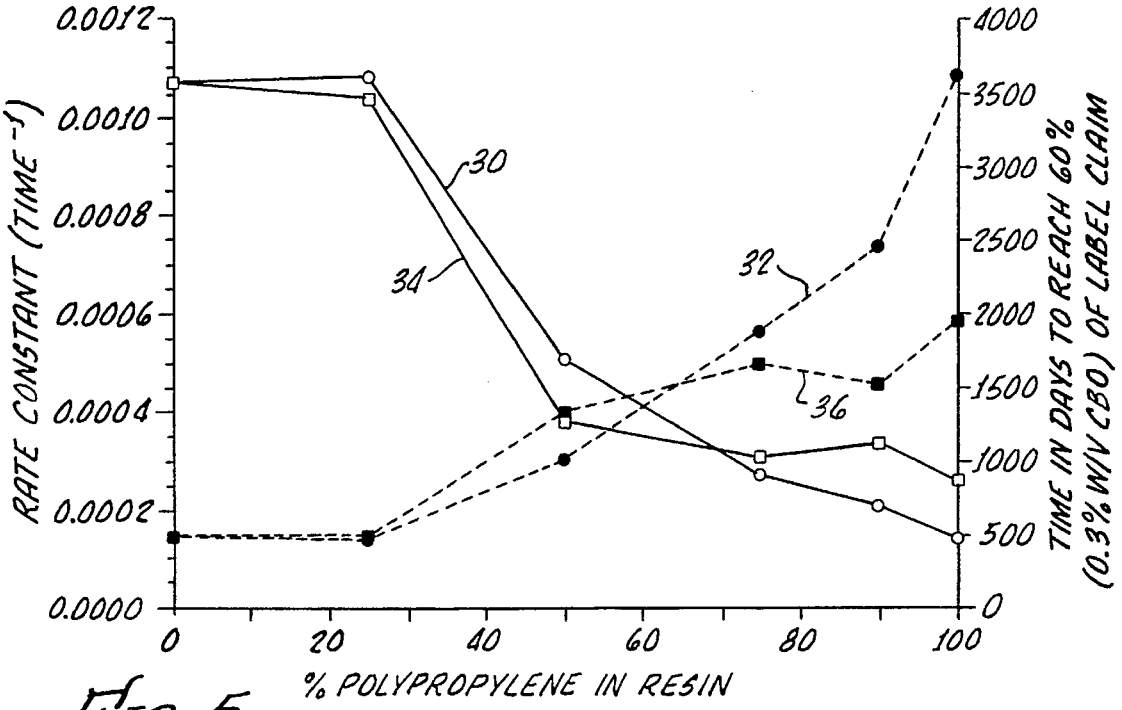
FIG. 5 is a plot of both rate constant and time in days to reach 60% of original chlorobutanol in the pharmaceutical product as a function of the amount of polypropylene in the resin for a polypropylene having a flexural modulus of 120,000 PSI and 145,000 PSI, all at a storage temperature of 25° C.
Figure 6:
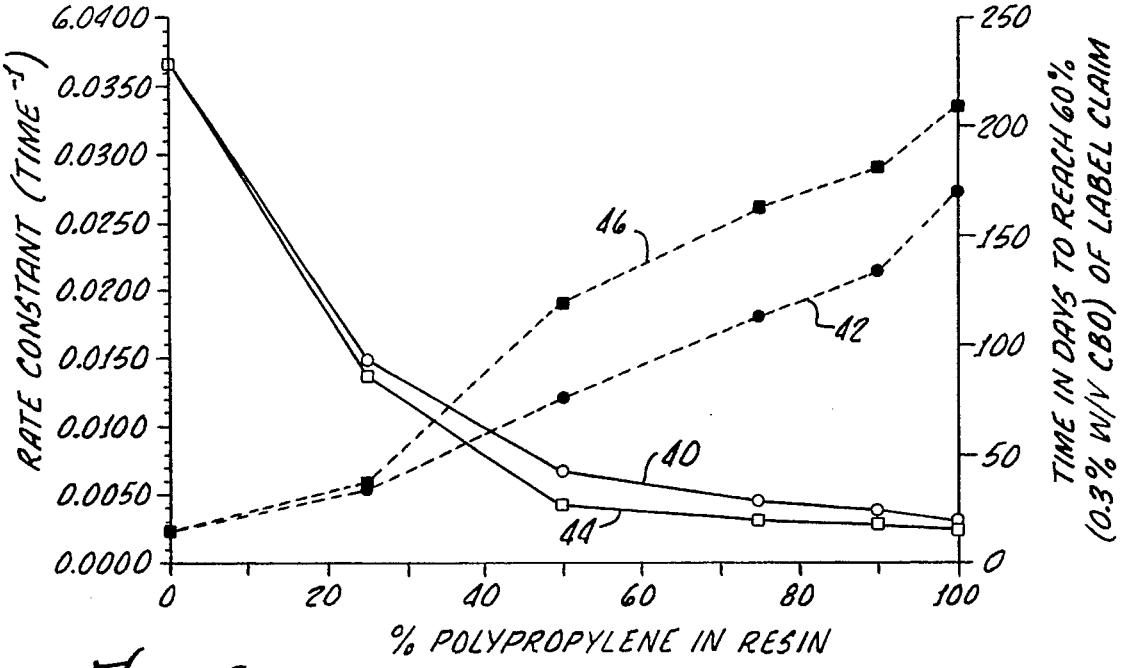
FIG. 6 is similar to the plot shown in FIG. 5 with the storage temperature being 45° C.

FIGS. 5 and 6 show the rate constant and the time and days to reach 60% of the original content of chlorobutanol, i.e., 0.3% W/V, as a function of the amount of polypropylene in the resin at storage temperatures of 25° C. and 45° C., respectively.

In FIG. 5, curve 30 and 32 represent a blend of Fina resin and polyethylene and curves 34, 36 represent a Rexene polypropylene blend with polyethylene. Similarly, in FIG. 6, curves 40 and 42 represent a Fina polypropylene/polyethylene blend and curves 44, 46 represent a Rexene polypropylene/polyethylene blend.

Of obvious importance, the squeezability of the container when formed from the blend of polypropylene and polyethylene, 10 ml bottles formed of the various blends of both Rexene polypropylene/polyethylene and Fina polypropylene/polyethylene were conducted, and suitable squeezable properties were determined to occur with Rexene polypropylene/polyethylene blends of 50% or less and with Fina polypropylene/polyethylene blends of 75% or less.

In these tests, a body wall thickness is between about 0.018" (0.46 mm) and about 0.032" (0.81 mm).

Most preferably, the body wall thickness is about 0.025" (0.63 mm).

Both resin blends give acceptable chlorobutanol properties at 50%, by weight, or more of polypropylene in the blend. Accordingly, it was determined that the most suitable blend is with the Fina polypropylene, having a flexural modulus of 120,000 PSI and a blend of between about 50%, by weight, polypropylene and 75%, by weight, polypropylene, with a target blend ratio of 60%, by weight, Fina polypropylene and 40% polyethylene, by weight.

Because the Rexene polypropylene is not squeezable above percentages of 50% polypropylene, by weight, in the blend and below 50% polypropylene, by weight, the barrier properties decrease. It was found that polypropylene having a flexural modulus greater than 120,000 PSI is not most suitable for providing a packaged pharmaceutical product in a squeezable bottle.

Although there has been described hereinabove a specific packaged pharmaceutical product and method of manufacture for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the invention as defined in the appended claims.

What is claimed is:

1. A packaged pharmaceutical product having extended shelf-life comprising:

a pharmaceutical preparation comprising chlorobutanol; and a dispensing container comprising:

a hollow body, having an open end therein, formed from a blend of low density polyethylene, having high chlorobutanol permeability, and a polypropylene, having low chlorobutanol permeability;

means, defining a body wall thickness, for both enabling drop-by-drop dispensing of the pharmaceutical preparation by manual squeezing of the body, and, in combination with the blend of polymers, preventing significant loss of chlorobutanol through the body wall upon storage of the container with the body filled with the pharmaceutical preparation; and dropper tip means, fixed to the body open end, for forming droplets of pharmaceutical preparation upon manual squeezing of the body.

2. The packaged pharmaceutical product according to claim 1 wherein the pharmaceutical preparation comprises chlorobutanol in an amount up to about 0.5 percent by weight.

3. The dispensing container according to claim 2 wherein the blend of polymers comprises between about 50% to 75% polypropylene and between about 50% to 25% polyethylene by weight.

4. The dispensing container according to claim 3 wherein the blend of polymers comprises about 60% polypropylene and about 40% polyethylene by weight.

5. The dispensing container according to claim 4 wherein the polypropylene comprises a random copolymer having a flexural modulus of about 120,000 psi.

6. The dispensing container according to claim 5 wherein the body wall thickness is between about 0.46 mm and about 0.81 mm.

7. A dispensing container for dropwise dispensing of a pharmaceutical preparation comprising chlorobutanol, said dispensing container comprising:

a hollow body, having an open end therein, formed from a blend of low density polyethylene, having high chlorobutanol permeability, and a polypropylene, having low chlorobutanol permeability;

means, defining a body wall thickness, for both enabling drop-by-drop dispensing of the pharmaceutical product by manual squeezing of the body, and, in combination with the blend of polymers, preventing significant loss of chlorobutanol through the body wall upon storage of the container with the body filled with the pharmaceutical preparation; and dropper tip means, fixed to the body open end, for forming droplets of pharmaceutical preparation upon manual squeezing of the body.

8. The dispensing container according to claim 7 wherein the blend of polymers comprises between about 50% and about 75% to polypropylene and between about 50% and 25% polyethylene by weight.

9. The dispensing container according to claim 8 wherein the blend of polymers comprises about 60% polypropylene and about 40% polyethylene by weight.

10. The dispensing container according to claim 9 wherein the polypropylene comprises a random copolymer having a flexural modulus of about 120,000 psi.

11. The dispensing container according to claim 10 wherein the body wall thickness is between about 0.46 mm and about 0.81 mm.

12. A dispensing container for dropwise dispensing of a pharmaceutical preparation comprising chlorobutanol in an original amount, said dispensing container comprising:

a hollow body, having an open end therein, formed from a blend of low density polyethylene, having high chlorobutanol permeability, and a polypropylene, having low chlorobutanol permeability;

means, defining a body wall thickness, for both enabling drop-by-drop dispensing of the pharmaceutical preparation by manual squeezing of the body, and, in combination with the blend of polymers, preventing significant loss of chlorobutanol through the body wall upon storage of the container with the body filled with the pharmaceutical preparation, said significant loss amounting to more than 40% W/V of said original amount of chlorobutanol over a period of at least 200 days at a storage temperature of about 25° C.; and dropper tip means, fixed to the body open end, for forming droplets of pharmaceutical preparation upon manual squeezing of the body.

13. The dispensing container according to claim 12 wherein the blend of polymers comprises between about 50% and about 75% to polypropylene and between about 50% and about 25% polyethylene by weight.

14. The dispensing container according to claim 13 wherein the blend of polymers comprises about 60% polypropylene and about 40% polyethylene by weight.

15. The dispensing container according to claim 14 wherein the polypropylene comprises a random copolymer having a flexural modulus of about 120,000 psi.

16. The dispensing container according to claim 15 wherein the body wall thickness is between about 0.46 mm and about 0.81 mm.

17. A method of packaging a pharmaceutical preparation comprising an original amount of chlorobutanol, said method comprising the steps of:

forming a container from a resin blend of polypropylene and low density polyethylene with a wall thickness enabling drop-by-drop dispensing of the pharmaceutical preparation by manual squeezing of said container and enabling storage of the pharmaceutical preparation for a period of at least about 200 days at about 25° C. without loss of more than about 40% of the original amount of chlorobutanol through the wall of the container;

filling the container with said pharmaceutical preparation; and providing a sealable nozzle for enabling drop-by-drop dispensing of said pharmaceutical preparation from the container.

18. A method of packaging a pharmaceutical preparation in a container for dropwise dispensing of the product, said pharmaceutical preparation comprising chlorobutanol, said method comprising the steps of:

preparing a blend of low density polyethylene, having high chlorobutanol permeability, and a polypropylene, having a low chlorobutanol permeability;

forming a hollow container, having one open end, with said blend, the container having a body wall with a thickness enabling both drop-by-drop dispensing of the pharmaceutical preparation by manual squeezing of the body wall, and, in combination with the blend, preventing significant loss of chlorobutanol through the body wall upon storage of the container with the container filled with the pharmaceutical preparation;

filling the container with said pharmaceutical products; and sealing the container open end with a dropper tip suitable for forming droplets of pharmaceutical preparations upon manual squeezing of the body wall.

19. The method according to claim 18 wherein the step of preparing a blend comprises mixing of between about 50% and about 75% polypropylene with about 50% to about 25% polyethylene by weight.

20. The method according to claim 19 wherein the step of preparing a blend comprises mixing about 60% to polypropylene with about 40% polyethylene by weight.

21. The method according to claim 20 further comprising the step of selecting a polypropylene having a flexural modulus of about 120,000 psi for blending with said polyethylene.

22. The method according to claim 21 wherein the step of forming the hollow container comprises forming the hollow container with the body wall thickness being between about 0.46 mm and about 0.81 mm.

* * * * *